United States Patent [19]

Fogarty et al.

[11] 4,319,532

[45] Mar. 16, 1982

[54] TOY SEWING MACHINE

[75] Inventors: Bonnie R. Fogarty; A. Edward Fogarty, both of Sarasota, Fla.

[73] Assignee: Hasbro Industries, Inc., Pawtucket, R.I.

[21] Appl. No.: 164,552

[22] Filed: Jun. 30, 1980

[51] Int. Cl.[3] ..... D05C 15/02; D05B 1/00

[52] U.S. Cl. ..... 112/79.5; 112/169

[58] Field of Search ..... 79/80, 79.5, 79 R, 169

[56] References Cited

U.S. PATENT DOCUMENTS

| | | | |
|---|---|---|---|
| 1,258,594 | 3/1918 | Miller | 112/169 |
| 3,127,859 | 4/1964 | Saltz et al. | 112/169 |
| 3,938,452 | 2/1976 | Windle | 112/80 |
| 4,011,823 | 3/1977 | Houghton et al. | 112/80 |
| 4,267,784 | 5/1981 | Heemstra | 112/80 |

*Primary Examiner*—Ronald Feldbaum

*Attorney, Agent, or Firm*—Salter & Michaelson

[57] ABSTRACT

A toy device adapted to loop a strand such as yarn through sheet material such as resinous foam fabric so as to simulate sewing or other needlework. The overall shape of the device simulates a sewing machine, that is, includes a platform on which material to be worked is held and a head supported in vertical spaced relationship thereabove. A hollow needle through which a strand may be threaded is supported on the bottom of a reciprocal plunger which when moved up and down, as by the child manipulating the device, causes the needle to project through the material and causes a series of loops to be formed on the back face thereof. A strand inserting device including a vertically reciprocal rod is positioned in alignment above the open end of the needle so as to thread the same. In the upper position of the plunger, the rod is independently operable from the plunger but acts in conjunction with the plunger in its lower position for safety purposes.

9 Claims, 7 Drawing Figures

TOY SEWING MACHINE

BACKGROUND AND SUMMARY OF THE INVENTION

This invention relates to a child's toy and more particularly to a device which is constructed so as to resemble and function in a manner similar to a fully operable sewing machine. Devices of this general nature are known and include those constructions disclosed in the following U.S. Pat. Nos. ARGIRO, et al, 2,878,614 issued Mar. 24, 1959; ZILG et al, 3,168,849, issued Feb. 9, 1965; and CLARK et al, 3,699,705, issued Oct. 24, 1972.

The structure disclosed in the above-indicated patents, although simulating sewing machines are not functional to the extent that a strand or strands of material are manipulated in such a fashion so as to simulate sewing or other needlework activity. It is accordingly an object of the present invention to provide a toy of the above-indicated general type which not only visually appears to be a sewing machine but actually functions in a manner to enhance such effect.

A further object of the present invention is the provision of a device of the aforementioned type which enables the child to produce unlocked stitches or loops in a sheet material such as fabric in such a manner that the material may be decorated in a manner simulating sewing, embroidery and other needle craft activities and so that the strand may be later withdrawn from the material and re-utilized.

A still further object of the present invention is the provision of a device of the aforementioned general type which is functional and has operable parts which simulate a function of a fully operable adult sewing machine but do so in a safe and trouble-free manner.

These and other objects of the present invention are accomplished by a device adapted to loop a strand through sheet material so as to simulate sewing and the like, comprising a housing incuding a platform for receipt of said material and a head vertically spaced above said platform, an upwardly biased spring loaded plunger having a strand-receiving hollow needle extending downwardly therefrom mounted on said head for reciprocal vertical movement with respect to said head between an upper position wherein said needle is positioned above the material supported on said platform and a lower position wherein the lower end of said needle is adapted to project through said material, means supported by said head and separate from said plunger for inserting strand into said hollow needle, said needle laterally offset from said plunger so as to provide access to the open upper end thereof and said strand inserting means including a rod vertically aligned with said needle and adapted for movement into at least the upper open end of said needle so as to thread said needle.

Other objects, features and advantages of the invention shall become apparent as the descripton thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
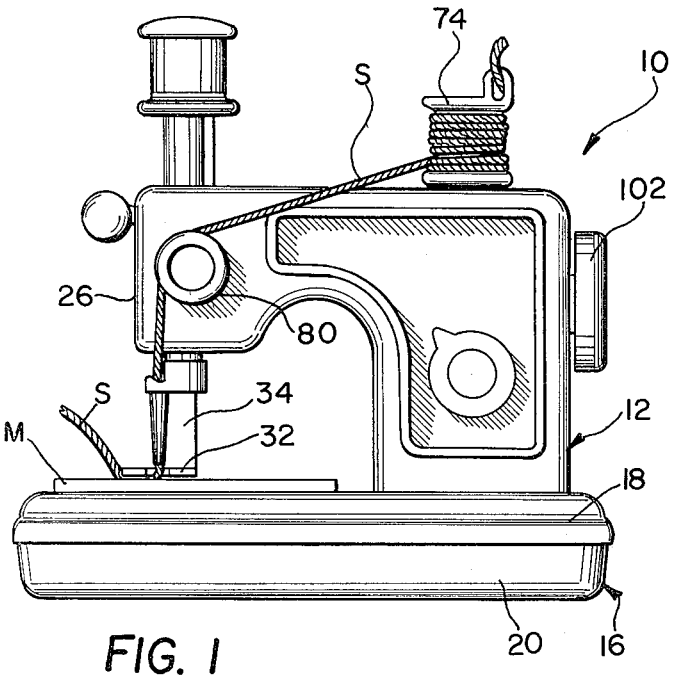
FIG. 1 is a side elevational view showing the device of the present invention with the needle thereof threaded with a strand, which strand has been initially looped or threaded through a piece of material supported on such device.
Figure 2:
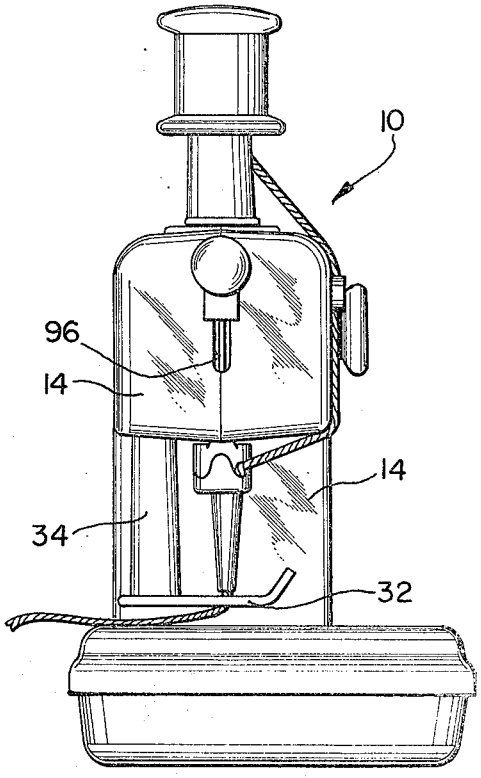
FIG. 2 is a front elevational view similar to FIG. 1 with the material therefrom.

Turning now to the drawings and more particularly FIGS. 1 and 2 thereof, the device 10 of the present invention includes an overall housing or body 12 that is constructed so as to simulate the shape of a sewing machine. The housing 12 includes a pair of opposed interconnected body shells 14. The housing 12 is adpated for upright support within a platform or base 16 including opposed upper and lower shells 18 and 20 respectively. The upper shell 18 includes a pocket 21 into which downwardly depending legs 22 of the body 12 may project. The platform 16 includes a forwardly extending portion in turn including an upper surface 24 which serves to support the material on which the device is to operate so as to simulate sewing, rug hooking or other needle related crafts in the intended manner. The material M is generally in sheet form and may be formed of any suitable material such as resinous foam, conventional fabric, netting or combinations thereof so long as a strand S may be projected therethrough by a needle in the intended manner. Sheet vinyl and cardboard may also be used if provided with pre-punched holes or slits for receipt of the needle. Generally the strand is in the form of a conventional plied yarn.

The housing 12 includes a forwardly projecting head 26 having an upper surface 28 and a lower surface 30. The head 26 is positioned in vertically spaced relatonship above the material supporting platform 24. A material hold-down plate 32 of conventional bifurcated configuration is positioned by means of a laterally offset supporting column 34 in turn connected to the housing. The hold-down plate 32 is positioned such that the slot 36 thereof is disposed above an opening 37 in the platform 24. The spacing between the hold-down plate 32 and the platform 24 is usually fixed at a distance so that the material being utilized is snugly received therebetween but can easily be repositioned as the simulated sewing or related needle craft activity takes place through operation of the device and as will hereinafter be more fully explained.

A plunger assembly 38 including an elongated tube 40 is mounted in the head 26 so that opposite ends of the tube 40 extend outwardly thereof. In that regard the upper surface 28 of the housing 26 includes an open bore 42 and an upwardly projecting collar 44 in which the upper end of the tube 40 is adapted for slidable engagement. A secondary collar 45 may also be present for positioning and for reinforcement. Intermediate the length of the tube 40 is a radially extending flange 46 fixedly attached thereto. The lower surface 30 of the head 26 is provided with a bore 48 also adapted to slidably engage the lower end of the tube 40. A lower guide 50 having an open bore 52 is positioned on the internal surface of the lower wall 30 and includes a seat 54 on which a coil spring 56 is adapted to rest. The upper end of the coil spring 56 engages lower surface of the flange 46.

Figure 3:
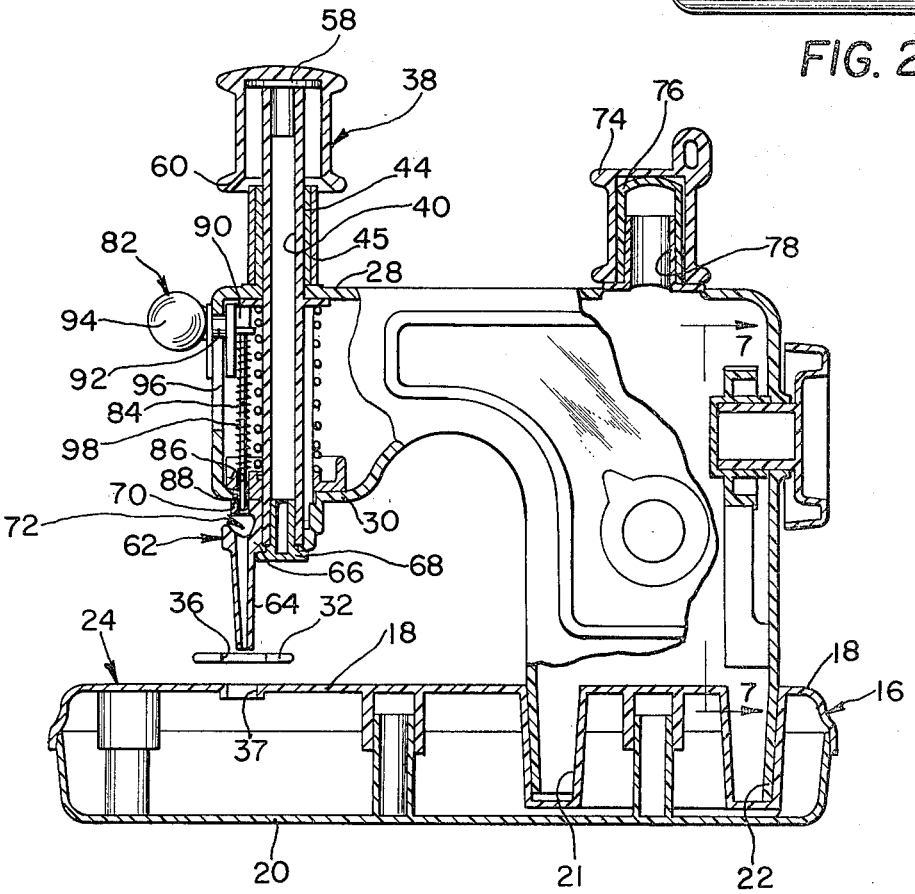
FIG. 3 is a side elevational view of the device similar to FIG. 2 and showing the overall operational manner thereof.
Figure 4:
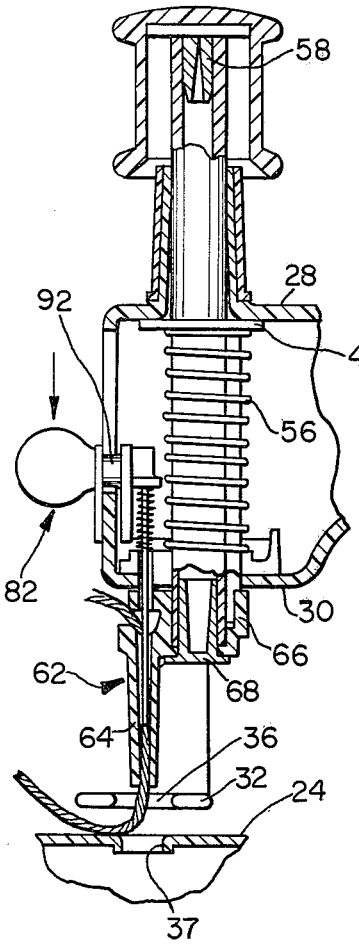
FIG. 4 is a partial sectional view of a portion of FIG. 3 showing the manner in which the strand threading device functions in the upper position of the needle.
Figure 5:
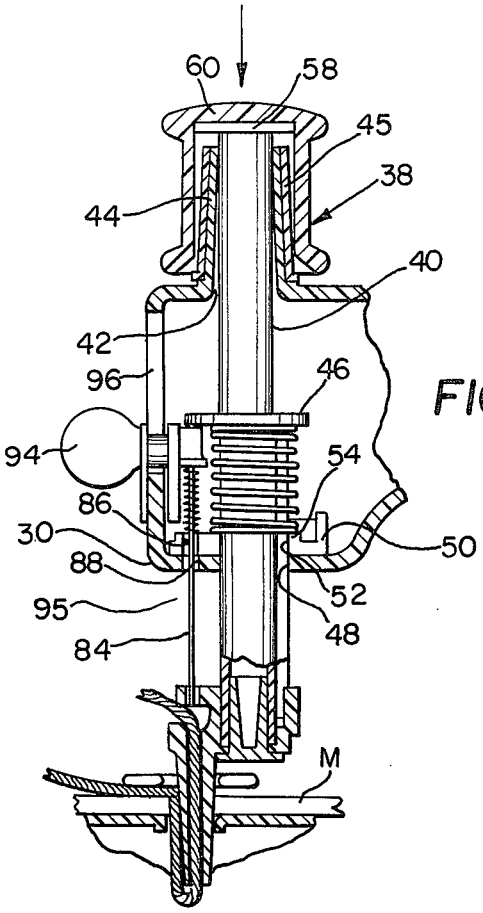
FIG. 5 is a view similar to FIG. 4 but showing the manner in which the needle may be forced downwardly through the material so as to create a loop with respect to the back face and a straight stitch effect on the top face thereof.

The upper end of the tube 40 is provided with a headed plug 58 on which a spool shaped hand engaging member 60 is adapted to rest. Downward pushing on the upper surface of the member 60 in the direction of the arrow shown on FIG. 5 moves the lower end of plunger 40 from its upper position as shown in FIGS. 3 and 4 to its lowermost position as shown in FIG. 5. Once the force is removed from the member 60, the coil spring 56 compressed by the downward motion of the plunger 40 serves to return the plunger assembly 38 to its uppermost position. The bottom of the tube or plunger 40 serves to mount a needle assembly 62. Such needle assembly 62 includes a hollow downwardly tapered needle 64 and an integral attachment band 66 which is adapted to encircle the lower portion of the tube 40. A cap member 68 is forced into the lower end of the tube and abuts the lower portions of the band 66 so as to position the needle assembly 62 thereon. The lower end of the needle 64 is open as is the upper end 70 thereof. Such upper end 70 is positioned in contact with or at least proximal to the lower surface 30 of the head 26. The needle further includes a forwardly open and inwardly projecting notch 72 into which strand S may be inserted for threading in the intended manner. Various lengths, colors, and thicknesses of strand can be utilized. A strand supply spool 74 is rotationally supported upon a hub 76 upwardly extending from the upper surface of the housing 12. A collar 78 may further be provided as an integral part of the body segment 14 and on which hub 76 is supported. A supply of strand such as plied yarn is wrapped around a spool 74 and then over a positioning guide 80 outwardly projecting from one side of the housing and thence as best shown in FIG. 2 around the remaining portions of the head 26 and into the notch 72.

In order to thread the strand through the hollow interior of the needle 64, a strand inserting assembly 82 is provided which assembly is also mounted in the head 26. The strand inserting assembly 82 includes a rod 84 mounted parallel to and forwardly of the plunger or tube 40 and adapted to extend through aligned openings 86 and 88 which respectively pass through the guide 50 and the lower wall 30. The upper end of the rod 84 is received within a cap 90 which in turn is attached to a shaft 92 which terminates in a forwardly projecting enlarged handle 94. The shaft 92 is disposed through an elongated slot 96 formed in the forward surface of the head 26. The lower end of the rod 84 is adapted to project into the upper section 70 of the needle 64. A coil spring 98 surrounds the rod 84 and serves to bias such to its upper position as shown in FIG. 3.

In the upper position of the plunger assembly 38, as shown in FIGS. 3 and 4, the yarn inserting assembly 82 is operable independently of the plunger assembly such that movement of the knob 94 downwardly forces yarn inserted in the notch 72 downwardly through the needle 64 and out the lower open end thereof. Such movement is partially shown in FIG. 4 and provides the necessary threading action desired. It is important that the rod 84 is in axial alignment with the hollow interior of the needle 64 and hence the needle is forwardly offset from the plunger assembly 38 as shown. It is also important that the yarn threading assembly 82 is not independently operable from the plunger assembly 38 when the plunger assembly 38 is in its lowermost position as shown in FIG. 5. In such position, it will be apparent that a gap or spacing 95 is present between the upper part of the needle 70 and the lower surface 30 of the housing and that in such position a child could easily place his or her finger in such gap and be injured should the rod 84 be inadvertently forced downwardly at that time. Accordingly, the flange 46 of the plunger 40 is adapted to contact the upper surface of the rod/head 90 on the downward stroke of the plunger assembly 38 such that the plunger assembly 38 and the yarn threading assembly 82 move as a unit on the downward stroke thereof and are maintained in such position so long as the plunger assembly is in its lower position, that is, so long as a downward pressure is maintained on the hand engaging member 60.

Figure 7:
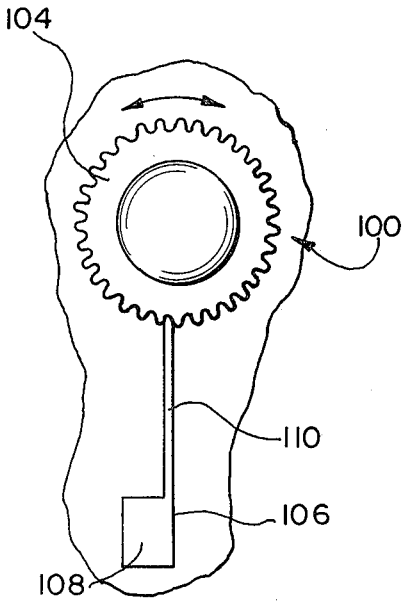
FIG. 7 is a view taken along the line 7—7 of FIG. 3 but shows in particular a noise making device associated with the present device.

In order to similate the noise of a sewing machine such that the enjoyment of the device 10 may be enhanced, a ratchet assembly 100 is provided. Such ratchet assembly 100 includes a wheel 102 outwardly projecting from the rear of the housing 12 and terminating inwardly thereof in a gear 104. A striker member 106 having a body 108 suitably secured to the internal surface of the housing includes an upwardly extending finger 110 adapted to contact the teeth of the ratchet 104 such that as the knob 102 is turned in either direction as shown by the arrows in FIG. 7, a sound simulating that of an operable adult sewing machine is made.

Figure 6:
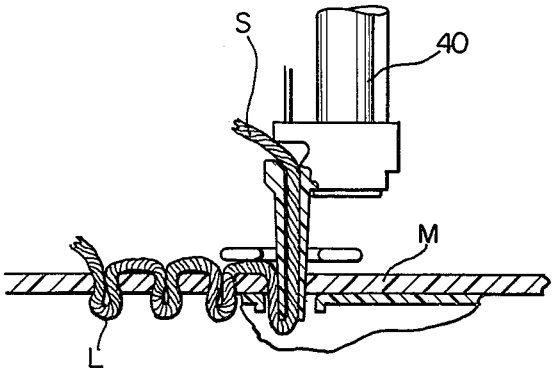
FIG. 6 is a partial view similar to FIG. 5 showing how the device of the present invention serves to form a series of loops through the material being worked upon.

The transition between FIGS. 4 and 5 as well as FIG. 6 illustrates the manner in which the needle serves to form loops in the material M in the intended manner. Thus, as the plunger assembly 38 is forced downwardly, the lower open end of the needle forces the strand S by frictional contact therewith through the material M and into interior portions of the platform 16 via the opening 37. The extent to which the needle penetrates the material on the lower or underside thereof determines the vertical height of the loops L thus formed. On the return of the needle 64 to its uppermost position the strand S is held by frictional contact with the material M and thus the needle is free to move with respect thereto, that is, the needle slides relative to the yarn on movement of the plunger assembly 38 to its upper position. Repeated cycling of the plunger assembly 38 combined with movement of the material M in the desired fashion forms a plurality of loops such that patterns, pictures, etc. can be formed. By varying the color of the strand, multicolored effects may be produced. In addition, buttons or other elements with large holes can be sewn to the material M to enhance the decorative effect. It should also be brought out that the strand may be simply removed from the material by pulling such out should it be desirable to reuse the material and/or the strand.

While there is shown and described herein certain specific structure embodying the invention, it will be manifest to those skilled in the art that various modifications and rearrangements of the parts may be made without departing from the spirit and scope of the underlyng inventive concept and that the same is not limited to the particular forms herein shown and described except insofar as indicated by the scope of the appended claims.

What is claimed is:

1. A toy device adapted to loop a strand through sheet material so as to simulate sewing and the like, comprising a housing including a platform for receipt of said material and a head vertically spaced above said platform, an upwardly biased spring loaded plunger having a strand receiving hollow needle extending downwardly therefrom mounted on said head for reciprocal vertical movement with respect to said head between an upper position wherein said needle is positioned above the material supported on said platform and a lower position wherein the lower end of said needle is adapted to project through said material, means supported by said head and separate from said plunger for inserting strand into said hollow needle, said needle laterally offset from said plunger so as to provide access to the open upper end thereof and said strand inserting means incuding a rod vertically aligned with said needle and adapted for movement into at least the upper open end of said needle so as to thread said needle.

2. The device of claim 1, said needle upper end disposed proximal to said housing head in the normal upper position of said plunger and spaced from said head in said lower position thereof, said strand inserting rod adapted for independent reciprocal movement into and out of said needle in said upper plunger position only.

3. The device of claim 2, said strand inserting rod being spring biased to its upper position, and means for interengaging said plunger and said rod during the downward stroke of said plunger such that the rod cannot be moved into the space between said needle upper end and said head while said plunger is in its lower position.

4. The device of claim 2, said housing including strand supply means mounted thereon whereby repeated reciprocal movement of said plunger serves to feed strand from said supply means to form separate loops of strand in said material.

5. The device of claim 2, including material hold down means supported by said housing and overlying said platform in spaced relation thereto.

6. The device of claim 1, said plunger slidably supported by said head and having upper and lower ends respectively adapted to extend out of said head at upper and lower surfaces thereof, said needle forwardly offset from said plunger.

7. The device of claim 6, said head including a slot disposed through a forward wall thereof, said rod having a forwardly, laterally extending handle projecting through said slot whereby said rod may be vertically reciprocated to thread said strand into said needle.

8. The device of claim 7, said plunger including a fixed position flange disposed intermediate the longitudinal extent thereof, a coil spring positioned around said plunger between said flange and said head lower surface whereby downward movement of said plunger compresses said spring, the upper end of said rod adapted to contact said flange whereby said rod moves downwrdly with said plunger.

9. The device of claim 8, said needle upper end having a forwardly open notch disposed proximal said head lower surface in said upper plunger position and into which strand may be inserted, said rod being upwardly spring biased and independently vertically reciprocal into and out of said needle and past said notch in said upper plunger position only.

* * * * *